US006715154B2

(12) United States Patent
Park

(10) Patent No.: US 6,715,154 B2
(45) Date of Patent: Apr. 6, 2004

(54) CAP WITH HIDDEN TEETH

(75) Inventor: Boo Y L Park, Seoul (KR)

(73) Assignee: Dada Corp., Seoul (KR)

( * ) Notice: Subject to any disclaimer, the term of this patent is extended or adjusted under 35 U.S.C. 154(b) by 30 days.

(21) Appl. No.: 10/142,770

(22) Filed: May 13, 2002

(65) Prior Publication Data

US 2003/0126671 A1 Jul. 10, 2003

(30) Foreign Application Priority Data

Jan. 4, 2002 (KR) ..... 20-2002-0000279

(51) Int. Cl.[7] ..... A42B 1/22

(52) U.S. Cl. ..... 2/195.2; 2/175.1; 2/181.6; 2/182.8; 2/183; 2/195.3

(58) Field of Search ..... 2/175.1, 181, 181.6, 2/183, 195.1, 195.2, 195.3, 417, 418, 182.8

(56) References Cited

U.S. PATENT DOCUMENTS 5,715,540 A * 2/1998 Cho ..... 2/195.3
6,016,572 A * 1/2000 Park ..... 2/195.2
6,052,831 A * 4/2000 Park ..... 2/195.2
6,119,273 A * 9/2000 Cho ..... 2/195.3
6,138,280 A * 10/2000 Bae ..... 2/181
6,163,888 A * 12/2000 Park ..... 2/183
6,502,246 B1 * 1/2003 Porter ..... 2/195.3

* cited by examiner

*Primary Examiner*—Gary L Welch
(74) *Attorney, Agent, or Firm*—Jacobson Holman PLLC

(57) ABSTRACT

A baseball-style cap having a free-size capability for accommodating wearers having a range of head sizes without a separate sizing mechanism. The cap includes a crown main body which is expandable at least in a peripheral direction, and a headband made of a substantially non-stretchable fabric material. The headband is connected to the lower peripheral edge of the crown main body by a piece of stretchable fabric which is sewn to cover the headband. The lower peripheral edge of the headband is incised or grooved at regular intervals such that a stretching force thereon in the peripheral direction causes the headband to demonstrate teeth appearance.

7 Claims, 2 Drawing Sheets

CAP WITH HIDDEN TEETH

BACKGROUND OF THE INVENTION

1. Field of the Invention

The present invention is related to the field of caps having visors and, more particularly, to a baseball-style cap which is adjustable to fit a variety of head sizes.

2. Description of the Related Art

A baseball style cap generally includes a crown main body and a visor portion that is secured to the forward edge of the crown and extends outwardly therefrom to provide protection from sunlight or rain. Typically, the cap also includes a headband which is sized to fit the wearer. Caps which can be adjusted to fit various wearers having different head sizes, referred to as "free size" caps, often include a size adjustment mechanism whereby the cap size is changed to fit the wearer.

Attempts have been made to produce a baseball-style free size cap which does not utilize a separate size adjustment mechanism. An example of such a cap is shown in U.S. Pat. No. 5,715,540, which teaches a cap having a plurality of panels, some of which are made of stretchable fabric materials, a crown main body and a sweatband that is secured to the lower peripheral edge of the interior of the crown. The sweatband is stretchable and fabricated with an unfolded elastic band. While the cap is expandable without the use of a separate size adjustment mechanism, the highly elastic band exerts considerable pressure on the wearer's head which can be uncomfortable. Furthermore, the cap does not maintain its shape well when not in use.

Another cap style is shown in U.S. Pat. No. 6,052,831 which, instead of using a stretchable band, relies upon a general band that is fabricated with a fabric material which interconnects the lower peripheral edge of the crown main body. Several incised lines are formed on the general band to make the band stretchable so as to fit wearers having different head sizes without undue pressure. However, the visible incised lines on the band are unattractive and seriously detract from the aesthetic quality of the cap.

Therefore, a need exists for free-size cap which is comfortable to wear and attractive in use.

SUMMARY OF THE INVENTION

In view of the foregoing, one object of the present invention is to provide an improved cap structure that is adjustable without a visible size adjustment mechanism.

Another object of the present invention is a cap having an aesthetically pleasing appearance without cumbersome or unattractive sizing mechanisms.

Yet another object of the invention is a free-size cap that is comfortable and does not exert undue pressure on the wearer's head.

In accordance with these and other objects, the present invention is directed to a cap having a hidden teeth. The cap includes a plurality of panels made of fabric forming a crown main body, a visor portion that is secured to the forward edge of the crown, a headband that is secured to the lower peripheral edge of the interior of the crown, and a stretchable fabric material that connects the lower peripheral edge of the interior of the crown to the headband. The headband is made of two-fold non-stretchable fabric material, with the lower peripheral edge of the headband preferably being grooved or incised at regularly spaced intervals. The stretchable fabric material is sewn to cover the incised or grooved portion of the headband such that a space is created by the stretchable material between the lower peripheral edge of the interior of the crown and the headband.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
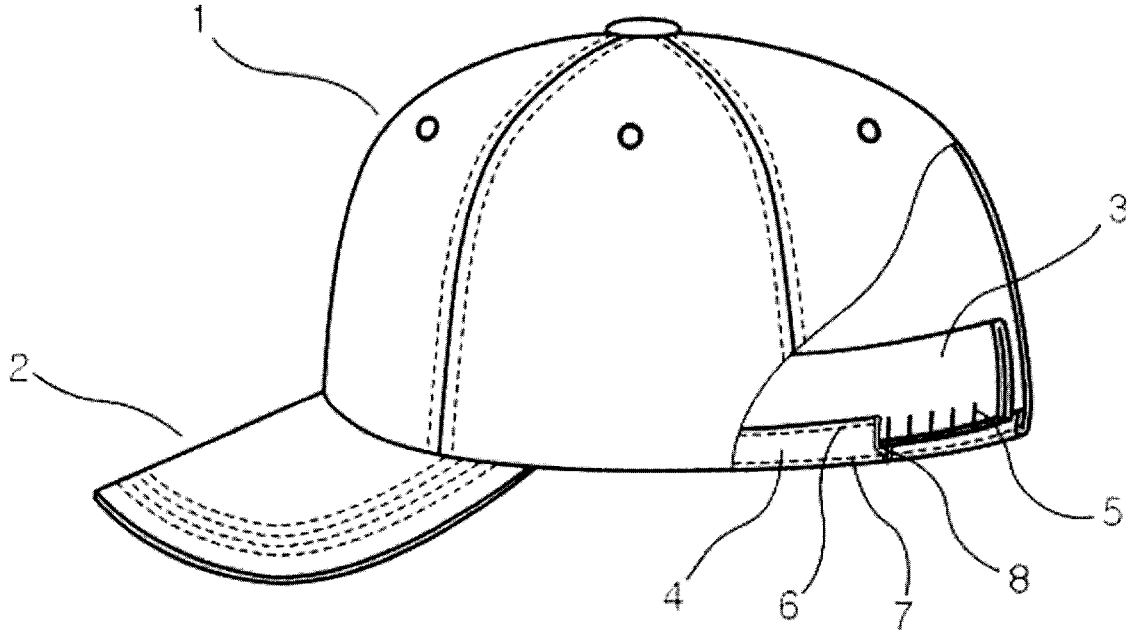
FIG. 1 is a side view with a partial cross-sectional view of a cap with hidden teeth in accordance with the present invention.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention, the present invention is directed to a baseball-style cap such as that shown in FIG. 1. As illustrated in the drawing, the cap includes a plurality of fabric segments forming a crown main body 1, a visor portion 2 that is secured to the forward edge of the crown, a headband 3 that is secured to the lower peripheral edge of the interior of the crown, and a strip of stretchable fabric 4 that connects the lower peripheral edge of the crown and the headband. The panels of the crown main body 1 are preferably made of one or more stretchable fabric materials so that the lower peripheral edges thereof are expandable in the peripheral direction for fitting the wearer's head size. The headband is composed of a non-stretchable material, however, so that it does not bind or exert pressure on the head and is therefore comfortable for the wearer. At a minimum, the headband must demonstrate limited stretching capability such that use of a fabric with some stretchability would still be acceptable.

According to a preferred embodiment, the lower peripheral edge of the headband 3 is incised or grooved at regularly spaced intervals to form incised portions 5, and the strip of stretchable fabric 4 is sewn thereto to cover the incised portions 5. With the stretchable fabric 4 sewn thereover, the incised portions 5 are not externally visible, giving the cap an attractive appearance in use.

The stretchable fabric is connected to the lower peripheral edge of the interior of the crown by sewing line 7, and is connected with the headband 3 by sewing line 6. The width of the stretchable fabric material 4 forms a region or space 8 separating the crown and the headband. The stretchability of the fabric material 4 and the space 8 which such fabric 4 creates between the crown and the headband provides the expansion capability necessary to the free-size function of the cap.

Figure 2A:
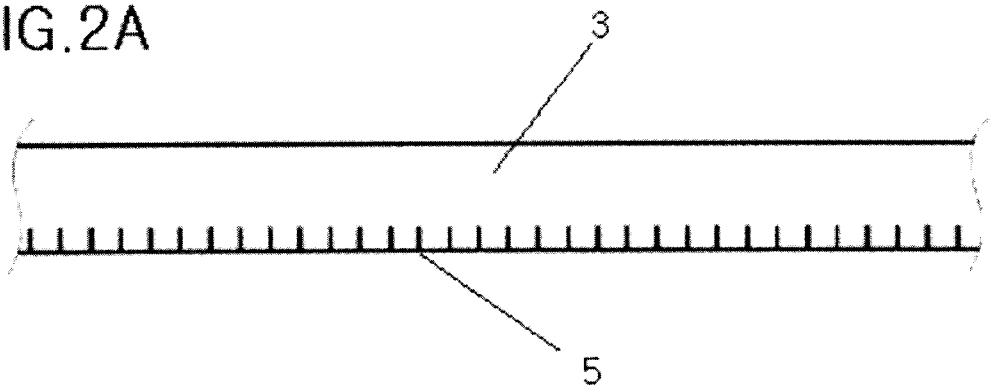
FIG. 2A is a plane view of an incised pattern for the hidden teeth of the cap of FIG. 1.
Figure 2B:
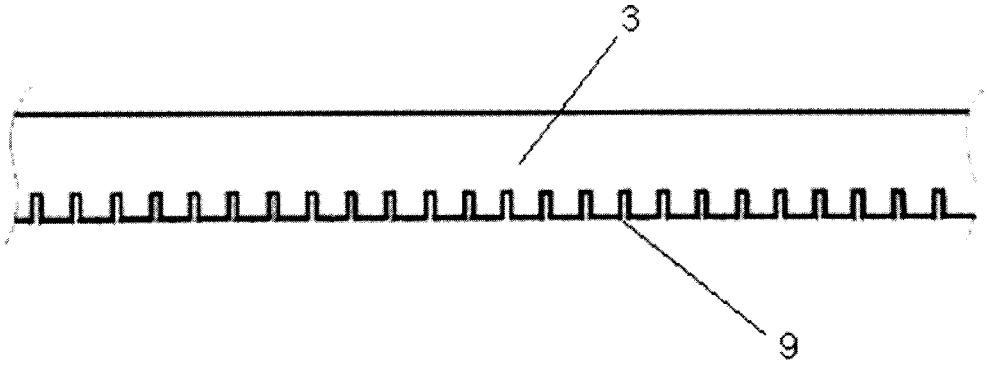
FIG. 2B is a plane view of a grooved pattern for a hidden teeth in accordance with the present invention.

FIGS. 2A and 2B are plane views of the headband 3 of the cap with hidden teeth according to the present invention. As illustrated in FIG. 2A, the headband 3 is incised at regularly spaced intervals to create incised portions 5. Alternatively, the headband may be grooved at regularly spaced intervals to create grooved portions 9, as shown in FIG. 2B. Other patterns of incising or cutting out of portions of the headband could also be employed. For example, generally vertical slits could be formed in the headband which could gap open to form somewhat circular holes in response to expansion force in the peripheral direction. Furthermore, the incisions or grooves may be regularly spaced and sized, or may be irregular in spacing and sizing. In any event, the headband is fabricated with two-fold, substantially non-stretchable fabric materials.

It is also possible to construct the cap with the piece of stretchable fabric material joining the crown and the headband, with the headband being without grooves or incisions. In this embodiment, the free-size function of the cap is provided by the stretchability of the fabric 4 across the space 8 which is formed between the crown and the headband by the width of the fabric 4. More particularly, because one longitudinal edge of the fabric 4 is connected to the headband by sewing line 6 and the other longitudinal edge of the fabric 4 is connected to the crown by sewing line 7, the region or space 8 formed by the width of the stretchable fabric 4 enables the cap to expand for variable head sizes.

Figure 3:
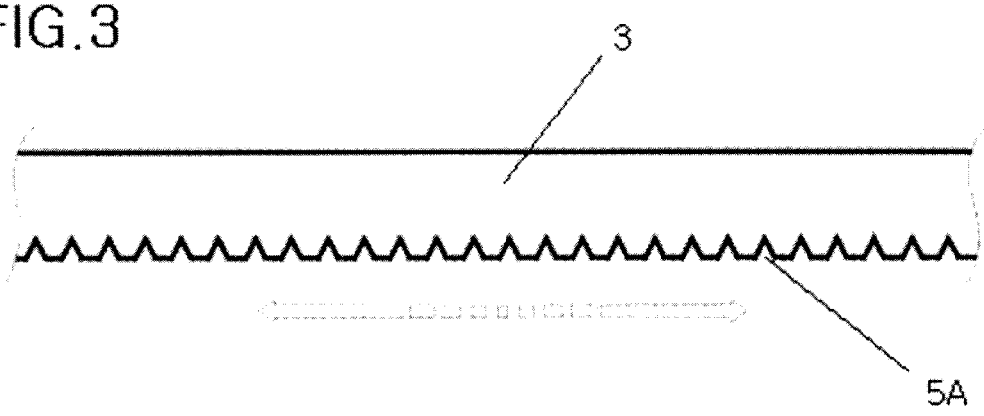
FIG. 3 is a plane view of the incised pattern of FIG. 2A, showing the hidden teeth when stretched as in use.

FIG. 3 is a plane view of the headband when the headband 3 is stretched, as indicated by the arrows. As already noted, the crown portion is made of stretchable material and is expandable in the peripheral direction. As shown, the headband, while formed of non-stretchable material, assumes the shape of teeth through broadening intervals 5A when the stretchable fabric of the crown portion is expanded. In this way, the cap according to the present invention can provide multiple size adjustment capability without exerting uncomfortable compression on the wearer's head.

As set forth herein, the cap with hidden teeth according to the present invention combines a stretchable crown main body with a headband fabricated from two-fold, essentially non-stretchable fabric materials. A piece of stretchable fabric material is used to connect the lower peripheral edge of the crown main body and the headband, and is sewn to cover the incised or grooved portions of the headband. Through such an inventive arrangement, the cap provides the advantageous feature of multiple size capability without the need for a separate sizing arrangement and is comfortable for the wearer, not causing undue compression on the head. Because the incised or grooved portions are not externally visible, the cap also provides a neat and attractive appearance in use.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the incising or grooving of a headband for limited expandability, combined with the covering of a piece of stretchable fabric, may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. An adjustable size cap comprising:

a crown main body having a plurality of panels and being expandable at least along a lower peripheral edge thereof;

a visor portion secured to a forward portion of said peripheral edge of said crown main body and extending outwardly therefrom;

a headband located at said lower peripheral edge of said crown main body, said headband formed of a substantially non-stretchable fabric material with only a lower peripheral edge thereof being incised at regularly spaced intervals to create incised portions, a depth of said incised portions being less than half a total width of said headband; and a piece of stretchable fabric connecting said headband to said lower peripheral edge of said crown main body and completely covering said incised portions.

2. The cap as set forth in claim 1, wherein at least one of said plurality of panels is fabricated with a stretchable material.

3. An adjustable size cap with hidden toothed band comprising:

a crown main body having a plurality of panels and being expandable at least along a lower peripheral edge thereof;

a headband located at said lower peripheral edge of said crown main body, said headband formed of a substantially non-stretchable fabric material and having a plurality of cuts therein which allow expansion of said headband, said plurality of cuts extending through only a lower pheripheral edge of said headband to a depth less than half a total width of said headband to create cut portions; and a piece of stretchable fabric connecting said headband to said lower peripheral edge of said crown main body, said piece of stretchable fabric sewn to create an elongated space through which said cut portions of said headband extend such that said stretchable fabric covers said cut portions of said headband while over half the total width of said headband remains uncut and uncovered.

4. The cap as set forth in claim 3, wherein at least one of said plurality of panels is fabricated with a stretchable material.

5. The cap as set forth in claim 3, wherein said plurality of cuts are incised at regularly spaced intervals.

6. An adjustable size baseball-style cap comprising:

a crown main body having a plurality of panels and being expandable at least along a lower peripheral edge thereof;

a visor portion secured to a forward portion of said peripheral edge of said crown main body and extending outwardly therefrom;

a piece of stretchable fabric sewn to said lower peripheral edge of said crown main body with a first line of stitching; and a headband formed of a substantially non-stretchable fabric material and sewn to said piece of stretchable fabric with a second line of stitching such that a width of said piece of stretchable fabric defines a stretchable region separating said crown main body and said headband;

a lower peripheral edge of said headband is grooved at regularly spaced intervals to create grooved portions that extend through less than half a total width of said headband, said piece of stretchable fabric being sewn to cover said grooved portions while a remainder of said total width of said headband remains uncovered.

7. The cap as set forth in claim 6, wherein at least one of said plurality of panels is fabricated with a stretchable material.

* * * * *